US006478536B2

(12) United States Patent
Döring et al.

(10) Patent No.: US 6,478,536 B2
(45) Date of Patent: Nov. 12, 2002

(54) EXHAUST TURBINE

(75) Inventors: Volker Döring, Stuttgart (DE); Hans-Dieter Hensel, Vaihingen (DE); Peter Schick, Esslingen (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/877,712

(22) Filed: Jun. 8, 2001

(65) Prior Publication Data

US 2002/0044869 A1 Apr. 18, 2002

(30) Foreign Application Priority Data

Jun. 9, 2000 (DE) ..... 100 28 751

(51) Int. Cl.[7] ..... F03B 3/18
(52) U.S. Cl. ..... 415/158
(58) Field of Search ..... 415/157, 158, 415/167; 417/407

(56) References Cited

U.S. PATENT DOCUMENTS 5,855,117 A * 1/1999 Sumser et al. ..... 415/158
5,910,000 A * 6/1999 Schade et al. ..... 415/158
6,224,333 B1 * 5/2001 Loeffler et al. ..... 29/889.1

FOREIGN PATENT DOCUMENTS

DE OS 19645388 5/1998

* cited by examiner

*Primary Examiner*—Edward K. Look
*Assistant Examiner*—Dwayne J. White
(74) *Attorney, Agent, or Firm*—Klaus J. Bach

(57) ABSTRACT

In an exhaust turbine for a turbocharger having a rotor rotatably supported in a turbine casing wherein the turbine casing has a spiral inlet with an annular space disposed directly around the rotor and an axial cavity extending from the annular space axially into the casing and slideably receiving a guide vane structure so as to be movable between a retracted position in the annular space and an extended position, in which the guide vane structure is disposed in the annular space, the guide vane structure has opposite outer and inner cover rings and the turbine casing has a recess opposite the axial cavity so that in the extended position of the guide vane structure its outer cover ring is fittingly received in the recess while the inner cover ring is disposed at the outer end of the axial cavity providing for a smooth inlet flow duct surface.

2 Claims, 1 Drawing Sheet

EXHAUST TURBINE

BACKGROUND OF THE INVENTION

The invention relates to an exhaust turbine for a turbocharger with a rotor rotatably supported in a turbine casing having a spiral inlet duct and provided with an annular space around the rotor provided with a guide vane structure.

DE 196 45 388 A1 discloses an exhaust turbine in which a guide vane structure can be moved axially into an annular space between a spiral inlet duct and a rotor. At its free end, the guide vane structure has a cover ring, which covers an annular gap in the turbine casing into which the guide vane structure is disposed in a retracted position of the guide vane structure. However, the cover ring reduces the axial extent of the annular space and forms a flow resistance in the form of a sharp-edged step in the contour of the spiral inlet duct. The step generates turbulence in the flow and thus causes a loss in efficiency.

It is the object of the present invention to improve the flow conditions in the region of the guide vane structure of the exhaust turbine.

SUMMARY OF THE INVENTION

In an exhaust turbine for a turbocharger having a rotor rotatably supported in a turbine casing wherein the turbine casing has a spiral inlet with an annular space disposed directly around the rotor and an axial cavity extending from the annular space axially into the casing and slideably receiving a guide vane structure so as to be movable between a retracted position in the annular space and an extended position, in which the guide vane structure is disposed in the annular space, the guide vane structure has opposite outer and inner cover rings and the turbine casing has a recess opposite the axial cavity so that in the extended position of the guide vane structure its outer cover ring is fittingly received in the recess while the inner cover ring is disposed at the outer end of the axial cavity providing for a smooth inlet flow duct surface.

With this arrangement, the cover ring presents no resistance to the flow of exhaust gas through the guide vane structure and the exhaust gas is deflected exclusively by the guide vanes. It is advantageous here for the edges of the cover ring walls adjacent the guide vanes to be rounded on the inflow side and to fit the contour of the flow duct in a flush manner.

The invention will become more readily apparent from the following description thereof on the basis of the accompanying drawings which illustrate an exemplary embodiment of the invention.

DESCRIPTION OF A PREFERRED EMBODIMENT

Figure 1:
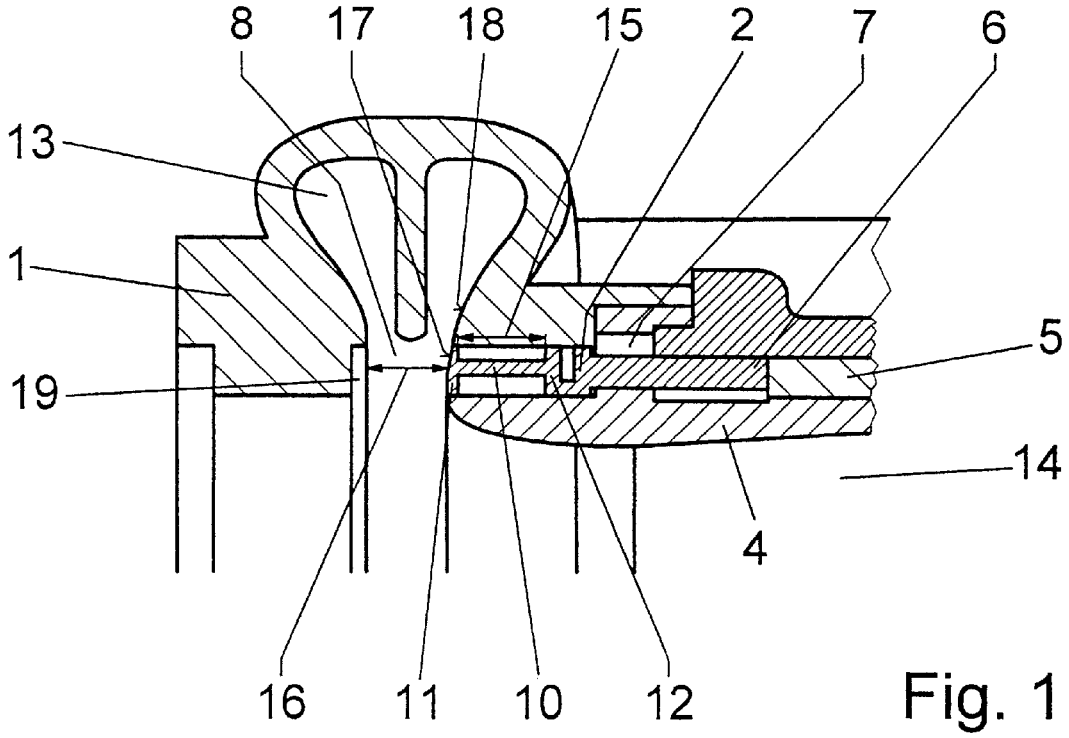
FIG. 1 is a partial longitudinal sectional view of a turbine casing of an exhaust turbine without the rotor and with a guide vane structure retracted from the exhaust gas flow path.

FIG. 1 shows a turbine casing 1 with a dual-flow spiral inlet duct 13, which opens into an annular space 8, of the turbine casing 1. Adjoining this annular space in the radial direction is a rotor (not shown specifically) of the exhaust turbine, through which the exhaust gases flows into an axially aligned outlet duct 14.

Figure 2:
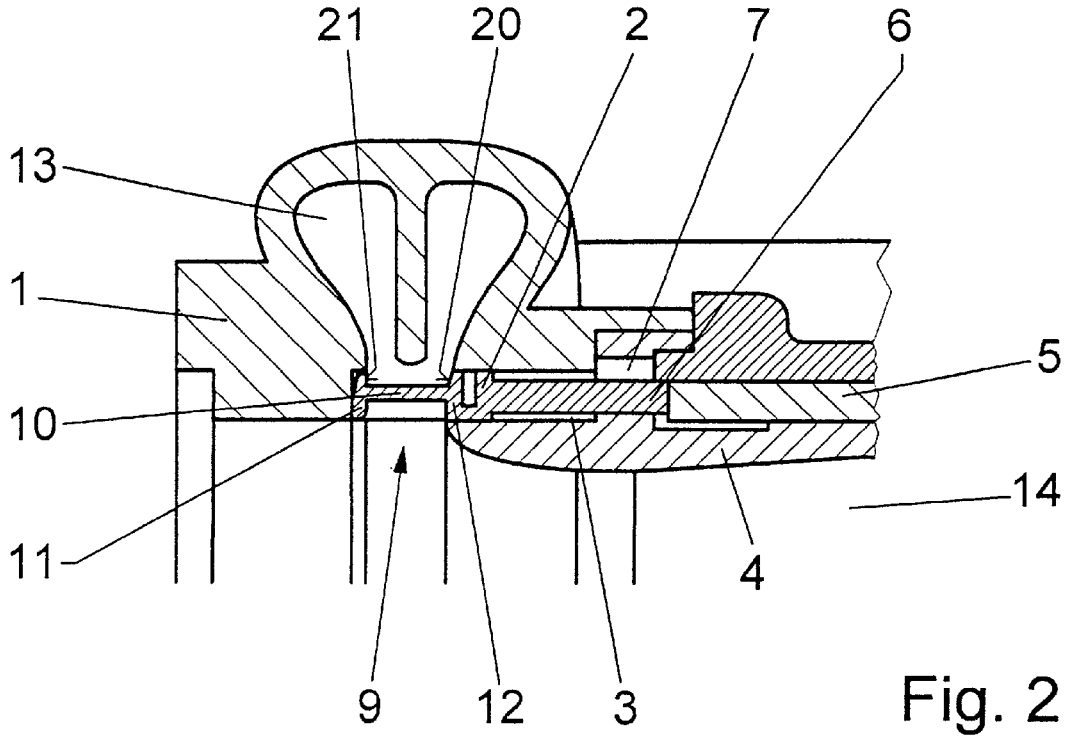
FIG. 2 shows a longitudinal section according to FIG. 1 with a guide vane structure extended so as to be disposed in the flow path.

An annular axial slide member 2, which carries a guide vane structure 9 with guide vanes 10, is provided in an annular cavity 3 in the turbine casing 1 around an inner guide 4 defining the outlet duct 14. The ends of the guide vanes 10 are connected to one another by cover rings 11 and 12. A bladed region 15 of the guide vane structure 9 corresponds in axial length to the axial extent 16 of the annular space 8. At the end of the axial slide member 2 remote from the inlet duct 13 the guide vane structure carries slide lugs 6, by means of which the axial slide member 2 is guided circumferentially in an axially displaceable manner in guide slots 7 of the inner guide 4. A sliding sleeve 5, which moves the axial slide member 2 into the annular space 8 (FIG. 2) or retracts it from the annular space (FIG. 1) acts on the ends of the slide lugs 6. In the extended position of the axial slide member 2, the cover ring 11 is received in a recess 19 in the turbine casing 1 and is overlapped axially by the recess at the inflow side. As a result, the cover ring 11 does not disrupt the gas flow through the annular space 8 and the exhaust gases are deflected exclusively by the guide vanes, which extend over the full axial length 16 of the annular space 8. It is advantageous for the edges 20 and 21 of the cover rings 11 and 12 which face the guide vanes on the inflow side to be rounded and to be flush with the contour 18 of the inlet duct (FIG. 2). In the retracted position of the axial slide 2 (FIG. 1), the cover ring 11 enters the annular cavity 3 to such an extent that its contour 17 facing the guide vanes is flush with the contour 18 of the inlet duct 13.

What is claimed is:

1. An exhaust turbine for a turbocharger, comprising: a turbine casing, a rotor rotatably supported in said turbine casing, said turbine casing having a spiral exhaust gas inlet for supplying exhaust gas to said rotor for driving said rotor and an annular space formed in said inlet directly adjacent said rotor, an annular guide vane structure slideably supported in an axial cavity formed in said casing such that said guide vane structure is slideable between an extended position in which said guide vane structure is disposed in said annular space and a retracted position in which said guide vane structure is contained in said axial cavity, said guide vane structure having outer and inner cover rings disposed at opposite axial ends thereof and said casing having an axial recess formed therein opposite said axial cavity, said outer cover ring being sized and shaped so as to be fitted into said recess when said guide vane structure is in its extended position while the inner guide vane ring is disposed at the outer end of said axial cavity so as to smoothly cover said cavity and said outer cover ring being disposed at the outer end of said axial cavity when said guide vane structure is in a retracted position and having an outer surface smoothly covering said axial cavity.

2. An exhaust turbine according to claim 1, wherein the edges of said cover ring that face said guide vanes are rounded on the inflow side and adjoin the contour of the inlet duct in a flush manner.

* * * * *